United States Patent [19]

Herber

[11] 3,979,324

[45] Sept. 7, 1976

[54] DYE SOLVENTS FOR PRESSURE-SENSITIVE COPYING SYSTEMS

[75] Inventor: John F. Herber, St. Louis, Mo.

[73] Assignee: Monsanto Company, St. Louis, Mo.

[22] Filed: Sept. 8, 1975

[21] Appl. No.: 611,465

[52] U.S. Cl. ..... 252/364; 252/316; 8/94 R

[51] Int. Cl.[2] ..... B01F 1/00

[58] Field of Search ..... 252/364, 316; 8/94

[56] References Cited

UNITED STATES PATENTS 3,846,331 11/1974 Konishi et al. ..... 252/364

*Primary Examiner*—Stephen J. Lechert, Jr.
*Attorney, Agent, or Firm*—William H. Duffey

[57] ABSTRACT

Solvent compositions useful to dissolve dyes employed in pressure-sensitive copying systems comprise:

A. about 45 to 75 weight percent of one or more compounds having the general formula

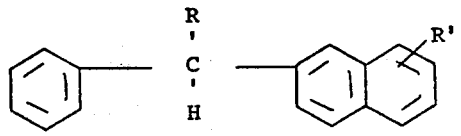

wherein R and R′ can be the same or different and are selected from the group consisting of hydrogen, methyl and ethyl; and B. about 55 to 25 weight percent of i. hexylbenzene; or ii. a composition comprising about 45 to 75 weight percent $C_{10}$ to $C_{16}$ alkanes and the balance $C_7$ to $C_{10}$ alkylbenzenes.

5 Claims, No Drawings

DYE SOLVENTS FOR PRESSURE-SENSITIVE COPYING SYSTEMS

BACKGROUND OF THE INVENTION

1. Field of the Invention

The present invention relates to pressure-sensitive copying systems of the kind in which a substantially colorless color former (dye) held within microcapsules is reacted, upon rupturing of the microcapsules by an applied pressure, with a co-reactant material to form distinctive colored marks. More particularly, the present invention relates to improved dye solvent compositions useful in pressure-sensitive copying systems.

2. Description of the Prior Art

In one conventional pressure-sensitive copying system, the microcapsules are carried on one surface of a transfer sheet, referred to as a CB (coated back) sheet and the co-reactant material is carried on one surface of a record sheet, referred to as a CF (coated front) sheet. In another embodiment, the microcapsules and the co-reactant material are carried on the same surface of a single sheet. In systems for making a plurality of copies, intermediate CFB (coated front and back) sheets are provided. The sheets are usually made of paper.

Most known CB sheets carry a coating of microcapsules, which may be separate or in capsular units, i.e., clusters of capsules. Each microcapsule comprises a wall of hydrophilic colloid material such as gelatin, containing a substantially colorless chromogenic material (color former) of basic reactant chemical properties which, in use, contacts and is colored by a co-reactant material.

The co-reactant material is typically a finely divided acidic compound which is also substantially colorless in its natural form. Commonly used co-reactant materials include organic polymers and inorganic clays which are applied to the CF sheet in a suitable paper coating binder material such as starch, casein, polymer or latex.

Distinctive colored marks occur on the CF sheet following rupture of the microcapsules through localized pressure from writing, typing or printing on the noncoated front surface of a CB sheet which is positioned with its coated back surface in contact with the coated front surface of a CF sheet.

The substantially colorless color former produces color only under acidic conditions, that is, upon contact with the acidic co-reactant of the CF sheet. The color former is always dissolved in a solvent and, in many cases, is diluted with kerosene or the like. It is therefore important that the color former solution possess the required physical and chemical properties.

Generally desirable properties of the color former solution are that it be easily encapsulated by conventional techniques; that it have good shelf life in the encapsulated form; and that it be stable at moderately elevated temperatures. It is also important that the mark produced as a result of the reaction between the color former and the co-reactant develop rapidly, be fade resistant and be resistant to bleeding or feathering as a result of capillary action or other surface phenomena.

The dye solvent (color former solvent) functions to provide a carrier for the color former and a medium for the reaction between the color former and the acidic co-reactant material. The solvent must be capable of holding the color former in solution within the microcapsule, of carrying the color former to the synthesized surface of the CF sheet when the microcapsule is ruptured, and of promoting or at least not inhibiting color development with the co-reactant. In addition, since inadvertent rupture of the microcapsule is possible by careless handling, the solvent must be noninjurious to skin, clothing or environment.

The solvent is an important factor in determining the performance of the pressure-sensitive copying system in terms of stability of the sheets to heat and storage time, rate of color development, extent of color development, and durability of image. Certain prior art dye solvents have exhibited adequate print speed and color intensity on the widely used phenolic resin-coated CF sheets. In some cases, however, objectionable odors in the copying systems have been ascribed to the dye solvent itself. Such odors obviously detract from commercial acceptance of such copying systems even though the dye solvent performance is otherwise superior.

Many non-halogenated aromatic hydrocarbons are known to the art as dye solvents for pressure-sensitive copying systems. Among these are diaryl methanes, alkylnaphthalenes, triaryl dimethanes, alkylated biphenyls and alkylated terphenyls. Benzylnaphthalene, also known as naphthyl phenyl methane, was disclosed as a dye solvent component in conjunction with any of the aromatics recited above. See U.S. Pat. No. 3,846,331 issued Dec. 5, 1974.

Notwithstanding the prior art contributions, there remains a need for a superior dye solvent composition which exhibits all the required properties, particularly in combination with modern co-reactant materials on the CF sheet, yet does not possess objectionable odor characteristics.

It is therefore an object of the present invention to provide dye solvents for pressure-sensitive copying systems which have low odor levels yet possess adequate print speed and color intensity together with otherwise acceptable properties. Further objects of the present invention will become apparent from the following description and examples.

SUMMARY OF THE INVENTION

It has been surprisingly found that benzylnaphthalene and closely related compounds, when blended in controlled amounts with certain alkylbenzenes or alkylbenzene-containing compositions, will provide dye solvents having outstanding performance.

Thus, the improved solvent compositions of the present invention useful to dissolve color formers employed in pressure-sensitive copying systems comprise:

A. about 45 to 75 weight percent of one or more compounds having the general formula

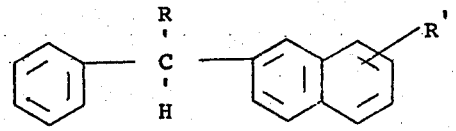

wherein R and R′ can be the same or different and are selected from the group consisting of hydrogen, methyl and ethyl; and B. about 55 to 25 weight percent of i. hexylbenzene; or ii. a composition comprising about 45 to 75 weight percent $C_{10}$ to $C_{16}$ alkanes and the balance $C_7$ to $C_{10}$ alkylbenzenes.

These solvent compositions afford rapid color development and excellent color intensity on phenolic resin CF sheets, with less odor than many prior art solvents known for this use.

DESCRIPTION OF PREFERRED EMBODIMENTS

The pressure-sensitive copying systems utilizing the improved dye solvents of the present invention may be prepared according to well known conventional procedures. Descriptions of methods for preparing the CB sheet and the CF sheet are to be found in the literature and such methods do not constitute a part of the present invention. Coating of the co-reactant material, whether inorganic clay or organic polymer type, is conducted according to such established procedures. Similarly, formation and application of microcapsules onto the CB sheet is fully disclosed in the literature. The solvent compositions of this invention may be substituted for conventional dye solvents in order to produce improved pressure-sensitive copying systems according to such conventional procedures.

The solvent compositions of the present invention are preferably utilized in combination with one or more of several conventional color formers of normally colorless form. One such class of color formers comprises colorless aromatic double bond organic compounds which are converted to a more highly polarized conjugated and colored form when reacted with an acidic sensitizing material on the CF sheet. A particularly preferred class of color formers includes compounds of the phthalate type such as crystal violet lactone (CVL) which is 3,3-bis(p-dimethylaminophenyl)-6-dimethylaminophthalide and malachite green lactone which is 3,3-bis(p-dimethylaminophenyl)phthalide. Other phthalide derived color formers include 3,3-bis-(p-m-dipropylaminophenyl)phthalide, 3,3-bis(p-methylaminophenyl)phthalide, 3-(phenyl)-3-(indole-3-yl)phthalides such as 3-(p-dimethylaminophenyl)-3-(1,2-dimethylindol-3-yl)phthalide, 3,3-bis(phenylindol-3-yl)phthalides such as 3,3-bis(1,2-dimethylindol-3-yl)-phthalide, 3-(phenyl)-3-(heterocyclic-substituted)phthalides such as 3-(p-dimethylaminophenyl)-3-(1-methylpyrr-2-yl-6-dimethylaminophthalide, indole and carbazole-substituted phthalides such as 3,3-bis(1,2-dimethylindol-3-yl)-5-dimethylaminophthalide and 3,3-bis(9-ethylcarbazol-3-yl)-5-dimethylaminophthalide, and substituted indole phthalides such as 3-(1,2-dimethylindol-3-yl)-3-(2-methylindol-3-yl)phthalide.

Other color formers also useful in the practice of this invention include indole substituted pyromellitides such as 3,5-bis(p-diethylaminophenyl)-3,5-bis(1,2-dimethylindol-3-yl)pyromellitide, 3,7-bis(p-diethylaminophenyl)-3,7-bis(1,2-dimethylindol-3-yl)pyromellitide, 3,3,7,7-tetrakis-(1,2-dimethylindol-3-yl)pyromellitide and 3,3,5,5-tetrakis-(1,2-dimethylindol-3-yl)pyromellitide; and leucauramines and substituted leucauramines such as p-xylyl-leucauramine and phenyl-leucauramine. Also included are orthohydroxybenzoacetophenone,2,4-bis[p-(p-dimethylaminophenylazo)aniline]-6-hydroxy-symtriazine, N,3,3-trimethylindolinobenzospiropyrans, and N,3,3-trimethylindolino-$\beta$-naphthospiropiranes.

An auxiliary coloring agent can be employed with the above color formers to provide fade resistance where fading is a problem. Many phthalide compounds such as crystal violet lactone for example, are characterized by rapid color development with a normal tendency to fade during the course of time. One suitable auxiliary coloring agent is benzoyl leuco methylene blue which oxidizes when released on the paper to slowly form a permanent blue color. The combination of a phthalide color former and such a colorless oxidizable auxiliary coloring agent provides a composition having both rapid color development and fade resistance.

The dye solvent compositions of this invention which are useful in pressure-sensitive copying paper systems comprise:

A. About 45 to 75 weight percent of one or more compounds having the general formula

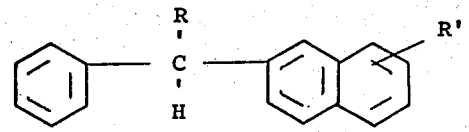

wherein R and R′ can be the same or different and are selected from the group consisting of hydrogen, methyl and ethyl; and B. about 55 to 25 weight percent of i. hexylbenzene; or ii. a compositfon comprising about 45 to 75 weight percent $C_{10}$ to $C_{16}$ alkanes and the balance $C_7$ to $C_{10}$ alkylbenzenes.

Surprisingly, it has been found that benzylnaphthalene and closely related compounds, when blended in determined amounts with hexylbenzene or a composition of $C_{10}$ to $C_{16}$ alkanes and $C_7$ to $C_{10}$ alkylbenzenes, will produce dye solvents having outstanding physical and chemical properties for their intended use herein. It was particularly surprising that the odor level of the compositions of this invention was acceptably low, especially in view of objectionable odor levels which have been previously encountered with certain diphenyl alkane dye solvents.

The solvent compositions of this invention are liquids at room temperature. Thus, they may be used alone in the microcapsule or may be combined with one or more diluents. For purposes of this invention the term "diluent" includes both inert or substantially inert materials which are of little practical use alone as dye solvents either because they have poor solvating power for the color former or because they act in some way to inhibit the development of color. Kerosene, paraffin oil, mineral spirits, castor oil, lard oil, olive oil, sardine oil, cottonseed oil, coconut oil and rapeseed oil are illustrative of prior art diluents. The diluent is usually employed in small amounts within the dye solvent composition, for example, in the range of from 0 to about 3 parts of diluent for each part of solvent. The diluents function to alter physical properties of the dye solvent compositions such as viscosity or vapor pressure as may be desired for handling or processing consideration. The diluents may also serve to reduce the total cost of the solvent composition in the system.

The dye solvent compositions of this invention may also contain certain additives specifically intended to alter or control the final properties of the fluid as, for example, viscosity control agents, vapor pressure control agents, freezing point depressants, odor masking agents, antioxidants, colored dyes and the like.

In a preferred embodiment of the present invention, the color former is dissolved in a selected dye solvent composition to form a marking liquid which is reactive with the co-reactant material on the CF sheet. Superior results were achieved herein with the resin type co-reactant materials. Within this class of co-reactant materials are phenolic polymers, phenolacetylene polymers, maleic acid-rosin resins, partially or wholly hydrolyzed styrene-maleic anhydride copolymers and ethylene-maleic anhydride copolymers, carboxy polymethylene and wholly or partially hydrolyzed vinyl methyl ether, maleic anhydride copolymers and mixtures thereof.

The dye solvent compositions of this invention, with or without the presence of a diluent, are microencapsulated according to procedures well known and broadly described in the art. The microcapsules are typically coated onto one surface of a CB sheet and the resin co-reactant material is carried on one surface of the CF sheet.

To illustrate the superiority of the dye solvent compositions of this invention, the rate and extent of color development of several solvents was determined in a laboratory procedure. Some of the tested solvents were within the scope of the present invention and some were outside. The laboratory procedure consisted of preparing a marking fluid comprising a solution of a color former in the solvent or solvent composition to be tested, applying the fluid to CF paper coated with a phenolic resin co-reactant material, and measuring the print speed and color intensity.

In the test procedure the marking fluid was prepared by adding sufficient crystal violet lactone color former to the solvent composition to achieve 1.5 weight percent concentration of the color former. This was followed by agitation and warming to 100°–120°C. if necessary to achieve solution. The solution was then cooled to room temperature, seeded with a few crystals of the color former, and allowed to stand for several days with occasional shaking to assure that the solution was not super-saturated.

The solvent/color former solution was thereupon saturated into a blotter. The blotter was daubed 7 times with a pencil eraser. The material on the pencil eraser, approximately 1 microliter of the solvent/color former solution, was transferred to a phenolic resin CF sheet and color intensity was measured. A Macbeth digital read-out Reflection Densitometer was employed using filters for color. The optical density measurements were seen visually and were recorded on a Sanborn Recorder which plots optical density versus time.

Print speed is defined herein as the time (in seconds) from injection of the solvent/color former solution until an optical density of 40 is achieved on the CF sheet. It has been found difficult to visually distinguish color change above a value of 40.

Color intensity for each of the samples tested was derived from the recording at a defined elapsed time.

The results of tests evaluating representative solvent compositions of this invention in comparison to related prior art compositions are presented in the Table which follows. The Table illustrates the generally superior performance obtained with the solvents of this invention. It also illustrates the surprising lack of performance on resin CF sheets for related compositions outside the present invention. The specific materials presented in the Table are for purposes of illustration only and the present invention is not to be limited thereto. Solvents A and G, in addition to the presence of 1.5 weight percent crystal violet lactone, also contained 1.5 weight percent benzoyl leuco methylene blue.

TABLE

| | | PHENOLIC RESIN CF SHEET | | |
|---|---|---|---|---|
| | | | Percent Color Development | |
| Solvent | Solvent Composition (By Weight) | Print Speed (Seconds) | at 60 Seconds | Maximum |
| A | 71% Benzylnaphthalene<br>29% of a 70:30% blend of $C_{13}$–$C_{15}$ alkanes and $C_9$–$C_{10}$ alkylbenzenes | 5 | 76 | 76 |
| B | 70% Benzylnaphthalene<br>30% Decylbenzene | 12 | 76 | 76 |
| C | 50% Benzylnaphthalene<br>50% Decylbenzene | 10 | 72 | 72 |
| D | 70% Benzylnaphthalene<br>30% Hexylbenzene | 8 | 73 | 73 |
| E | 50% Benzylnaphthalene<br>50% Hexylbenzene | 5 | 70 | 70 |
| F | 71% Benzylnaphthalene<br>29% of a 59:41% blend of $C_{12}$–$C_{14}$ alkylbenzene and $C_{10}$–$C_{11}$ alkylbiphenyl | 25 | 68 | 68 |
| G | 100% Monobenzylated Ethylbenzene (a diphenyl alkane) | 4 | 81 | 82 |
| H | 100% Monoisopropylbiphenyl | 7 | 78 | 78 |

Print speed and color development data presented in the above Table illustrate the surprising superiority of dye solvent compositions within the scope of the present invention. Solvents A, D and E are within the present invention. It was entirely unexpected that solvent A and solvent F, both comprising 71:29% blends of benzylnaphthalene and alkylbenzene-containing components, would differ so dramatically in print speed. Solvent A, which is within the present invention, exhibited a print speed of 5 seconds on resin CF sheet in comparison to a print speed of 25 seconds for solvent F on the same CF material.

Monoisopropylbiphenyl (solvent H) is a well known dye solvent useful with phenolic resin CF sheet. Solvents A and E, both within the present scope, exhibited print speeds superior to that of monoisopropylbiphenyl. Solvents A, D and E all exhibited less odor than solvent G.

Benzylnaphthalene, sometimes called naphthylphenylmethane is a preferred component within the compositions of this invention. Some other naphthyl-containing compounds within the generic formula (A) of this invention are naphthylphenylethane, methyl-naphthylphenylmethane and methylnaphthylphenylethane. These compounds may be readily prepared by condensing naphthalene and/or methylnaphthalene and benzylchloride in the presence of a catalyst of ferric chloride. The naphthylphenylethanes can also be readily prepared by condensing naphthalene and/or methylnaphthalene and styrene in the presence of sulfuric acid or like catalyst. These compounds have a number of isomers which are different from each other only in the positions of the substituted groups. Any one of these compounds is suitable for use in the dye solvent compositions of the present invention either as a pure compound or as a mixture of two or more isomers. Mixtures of two or more of the aforementioned naphthyl-containing compounds are also suitable for use in the compositions of the present invention. These components may be in the form of liquid or solid at room temperature.

Hexylbenzene can be prepared according to widely known techniques. While the presence of hexylbenzene in the dye solvent composition can vary between about 25 and 55 weight percent, superior results have been achieved at a concentration of about 45 to 55 weight percent.

When component (B) is a composition comprising $C_{10}$ to $C_{16}$ alkanes and $C_7$ to $C_{10}$ alkylbenzenes, the concentration may range from about 25 to 55 percent by weight of the solvent composition although the preferred concentration is about 25 to 35 percent by weight.

The mixture of $C_{10}$ to $C_{16}$ alkanes and $C_7$ to $C_{10}$ alkylbenzenes is derived from petroleum sources. A preponderance of $C_{13}$ to $C_{15}$ components is generally found in the alkane (paraffin) portion of the mixture. Thus, $C_{13}$ to $C_{15}$ alkanes represent the preferred embodiment. The alkanes represent 45 to 75 weight percent of the mixture. The aromatic portion of the mixture, representing about 25 to 55 weight percent, consists essentially of $C_7$ to $C_{10}$ alkylbenzenes, predominantly $C_9$ to $C_{10}$ alkylbenzenes in most instances. Preferably, the aromatic portion or fraction of the mixture is present in about 25 to 35 weight percent.

Although the aromatic portion of the aforementioned mixture is referred to as "$C_7$ to $C_{10}$ alkylbenzenes", it is to be understood that certain unidentified aromatic and cycloparaffin compounds may be present therein. These compounds may occur naturally in this petroleum-based mixture. Typical compounds of this type might include alkyl indane, alkyl tetralin, naphthalene and the like, all in relatively small amounts if present.

When carbon numbers are employed herein in conjunction with alkylated aromatic compounds such as alkylbenzene or alkylbiphenyl, the numbers signify the carbon atom content of the alkyl groups and not the total carbon atom content of the aromatic molecule. For example, $C_{10}$ alkylbenzene would have a total carbon content of 16.

The embodiments of the invention in which an exclusive property or privilege is claimed are defined as follows:

1. A dye solvent composition for use in pressure-sensitive copying systems comprising A. About 45 to 75 weight percent of one or more compounds having the general formula

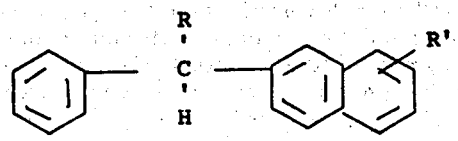

wherein R and R' can be the same or different and are selected from the group consisting of hydrogen, methyl and ethyl; and B. about 55 to 25 weight percent of i. hexylbenzene; or ii. a composition comprising about 45 to 75 weight percent $C_{10}$ to $C_{16}$ alkanes and the balance $C_7$ to $C_{10}$ alkylbenzenes.

2. A composition of claim 1 wherein the compound of (A) is benzylnaphthalene.

3. A composition of claim 2 wherein component (B) is hexylbenzene.

4. A composition of claim 3 wherein hexylbenzene is present in about 45 to 55 weight percent.

5. A composition of claim 2 wherein component (B) is a composition comprising about 65 to 75 weight percent $C_{13}$ to $C_{15}$ alkanes and the balance $C_9$ to $C_{10}$ alkylbenzenes.

* * * * *